US006493966B1

(12) United States Patent
Braun

(10) Patent No.: US 6,493,966 B1
(45) Date of Patent: Dec. 17, 2002

(54) SOLE STRUCTURE FOR A SHOE OR AN INNER SOLE

(76) Inventor: Walter Braun, Kirchenweg 12, 63840 Hausen (DE)

( * ) Notice: Subject to any disclaimer, the term of this patent is extended or adjusted under 35 U.S.C. 154(b) by 0 days.

(21) Appl. No.: 09/720,800

(22) PCT Filed: Jun. 30, 1999

(86) PCT No.: PCT/DE99/01882

§ 371 (c)(1),
(2), (4) Date: Jan. 18, 2001

(87) PCT Pub. No.: WO00/01267

PCT Pub. Date: Jan. 13, 2000

(30) Foreign Application Priority Data

Jun. 30, 1998 (DE) ..... 198 29 072

(51) Int. Cl.[7] ..... A43B 13/38
(52) U.S. Cl. ..... 36/44; 36/30 R
(58) Field of Search ..... 36/43, 44, 30 R

(56) References Cited

U.S. PATENT DOCUMENTS 3,852,897 A * 12/1974 Bridge et al.
4,062,131 A * 12/1977 Hsuing
4,192,086 A * 3/1980 Sichak
4,461,099 A * 7/1984 Bailly
4,469,740 A * 9/1984 Bailly
4,709,490 A * 12/1987 Fottinger et al.
5,994,245 A * 11/1999 Marier et al.

FOREIGN PATENT DOCUMENTS

| | | |
|---|---|---|
| DE | 3032941 | * 4/1982 |
| DE | 19814349 | * 10/1999 |
| EP | 498965 | * 8/1992 |
| WO | 9740717 | * 11/1997 |

* cited by examiner

*Primary Examiner*—Ted Kavanaugh
(74) *Attorney, Agent, or Firm*—Edwin D. Schindler

(57) ABSTRACT

A sole structure for a shoe or an inner sole, includes two layers. A first layer is an upper layer exhibiting a diffusion porosity, while the second layer is a lower layer, which is made of a fibrous material containing absorbent fibers. The upper and lower layers are placed one atop of the other and needle-bound together. A method for producing the sole structure is also provided.

12 Claims, 1 Drawing Sheet

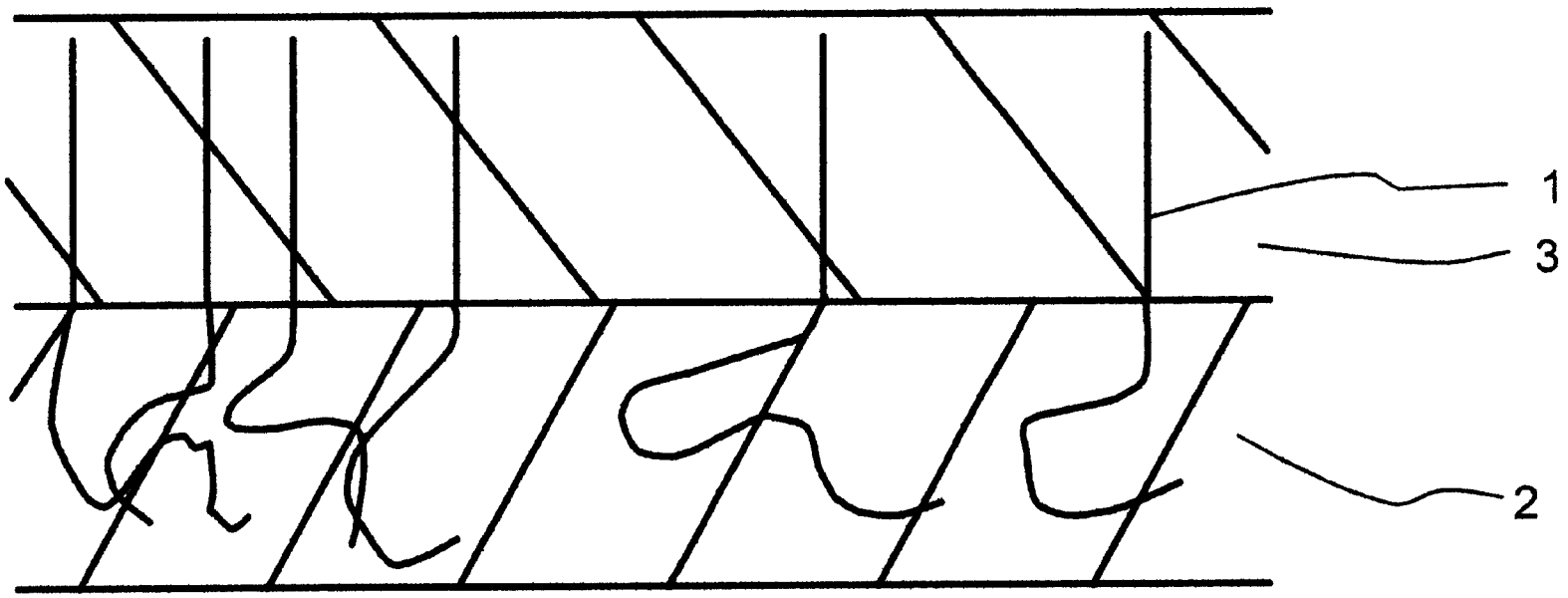
1
3
2

SOLE STRUCTURE FOR A SHOE OR AN INNER SOLE

This application is a 371 of PCT/DE99/01882 filed on Jun. 30, 1999.

BACKGROUND OF THE INVENTION

1. Technical Field of the Invention

The invention relates to a sole structure for a shoe or an inner sole, which comprises at least two layers. The invention also relates to a method for producing such a sole structure.

Within the meaning of the invention, sole structure is understood to mean the part of the shoe under the sole of the user's foot, which can also be configured as an inner sole. Human feet, especially their soles, are among the parts of the body that tend to a high secretion of sweat. This is problematic because feet are often enclosed in shoes for hours, which unlike other garments are difficult to access for intensive cleaning with the consequence that shoes are partly subject to a considerable development of odour. Moreover, because shoes are designed to prevent the penetration of moisture, it is hardly surprising that the desorption of the moisture from foot perspiration only occurs slowly. The interior of the shoe is therefore often moist so that an atmosphere results in which bacteria and fungus can easily multiply. Foot injuries, such as blisters, only heal slowly in such an environment.

2. Description of the Prior Art

To solve this problem, inner soles are known which can absorb moisture. Such soles can be inserted into the shoe and replaced from time to time. The European patent application EP 0 693 259 A2 describes a sole structure in which individual elements are more or less positioned where most of the sweat glands are located on the foot and are replaceable. The replaceable elements also have the known advantages of inner soles. However, no sole structure is currently known which is able to absorb a lot of moisture and isolate the moisture from the sole of the foot, which moreover removes the moisture at the same time quickly from the region of the sole of the foot and desorbs the moisture again into the environment when the shoes are removed.

SUMMARY OF THE INVENTION

By way of contrast, the invention has the object of creating a sole structure which has all these properties and at the same time is easy to produce.

In accordance with the invention, this task is solved therein that the upper layer exhibits a diffusion porosity and the lower layer is composed of a fibrous material containing absorbent fibres. The said two layers are needle-bonded.

The basic idea of the invention is to create a lower layer that is composed of absorbent fibres in order to store the moisture and above this to arrange an upper layer which isolates the moisture from the sole of the foot. To allow the moisture to be desorbed in case the shoes are not being used, the upper layer must exhibit a diffusion porosity. Moreover, the two layers are needle-bonded so that the absorbent fibres that absorb the moisture of the upper layer are disposed in the upper layer and they divert the moisture into the lower layer owing to their absorbency. The absorbent fibres therefore act like channels which remove the moisture from the upper layer. The inventive sole structure is thus absorbent, without being damp on the surface, whereby the moisture can also easily evaporate. Moreover, it is easy to produce.

To accelerate the removal of moisture from the upper layer, absorbent fibres have to be needled into and penetrate far into the upper layer, that is as far as possible, above the center of the upper layer or even until directly below the upper surface of the upper layer. To isolate the moisture from the sole of the foot, the absorbent fibres, however, should not be in direct contact with the sole of the foot, that is, not extend entirely as far as the top side of the upper layer.

In an advantageous configuration of the invention, the upper layer is composed of a fleece. Such a material is easy to wear and easy to needle-bond. The processing of such a top layer is also easy. As a preferred material for the top layers, polyester ("PES") is recommended. Such synthetic materials as polyester, have a diffusion porosity and have already proven themselves in shoe soles.

The lower layer is also preferably composed of a fleece for the above mentioned reasons, which, however, must be absorbent. As materials especially viscose materials, polyamides or cotton recommend themselves.

The layers of an inventive sole structure are ideally thick enough so that the upper layer isolates the moisture well from the sole of the foot and the lower layer can store sufficient quantities of moisture. Thereby the total sole structure, however, should not be too heavy and also not too thick or otherwise the sole overall has a spongy effect. To fulfill these properties, the lower and the upper layer respectively should as far as possible have a mass per unit area of 300 to 400 g/m$^2$.

The range of applications for the inventive sole structure is varied. It can be used both for walking shoes, with or without inlays, in climbing, hiking or ski boots as well as in sports shoes and rubber boots. The introduction is possible in both men's as well as women's shoes. To that end, the sole structure can be integrated into shoes or be used as an inner sole separate from the shoe. Correspondingly, there are also different forms for the inner soles or the sole structure. However, to configure the production process of the different soles in a similar way, the invention proposes to use a formable material in at least one of the two layers and to form the sole structure. Suitable for this purpose is especially a fusible fibre proportion in one or both layers. The sole structure can then be shaped under the influence of heat and can then also serve as a support for an inlay. Depending on the field of use, different shapes are possible.

Materials that are proposed for the inventive sole structure, especially fleeces, have the property that frictional electricity may be produced therein so that the sole structure may possibly build up a large charge. To discharge these charges it is proposed to dispose in at least one of the layers conductive fibres, especially fibres made of steel or carbon. Via conductive fibres, moreover, an electric contact can be produced between the person and the ground so that the frictional electricity is continuously carried away from the person. This allows electric shocks to be prevented which a person might experience due to static charges. Furthermore, damage, particularly to electronic equipment, which can be caused through operation by statically charged persons, can be eliminated with the use of the corresponding shoes. By means of needle-bonding, conductive fibres, which are disposed solely in one layer, can also be introduced into the other layers.

The invention proposes furthermore a method for producing such a sole structure. Thereby, the two layers are placed one upon the other and then needle-bonded together. The production process is simple and enables the production of high-quality soles.

A further subject of the invention is a formed sole. This property is attainable through a proportion of formable material in one of the layers. As far as possible, the forming is executed after the needle-bonding because it is very difficult to needle-bond a formed sole structure. A sole structure can also be delivered in an unformed condition to a shoe producer and then be formed by the shoe producer, which can be done especially easily if fusible fibres are used.

BRIEF DESCRIPTION OF THE DRAWING FIGURES

FIG. 1 is a schematic diagram of an embodiment of the present invention illustrating a vertical section taken through the inventive sole structure.

DETAILED DESCRIPTION OF THE DRAWING

The inventive sole structure comprises an upper layer (1) and a lower layer (2) which are needle-bonded. The upper layer (1) exhibits a diffusion porosity and the lower layer (2) contains absorbent fibres (3), which are only indicated in the figure, which through needle bonding have in part been inserted into the upper layer. The absorbent fibres (3) there act like channels which carry away the moisture arising under the sole of the foot into the lower layer. If the shoes are not worn, the moisture from the lower layer (2) can escape through the diffuision-porous upper layer (1). Thus fast drying of the sole is possible. The inventive sole structure can be configured as a replaceable inner sole or be integrated into the shoe.

What is claimed is:

1. A sole structure for a shoe or an inner sole, consisting of:

an upper layer comprising a fleece and having a diffusion porosity; and, a lower layer comprised of a fibrous material containing absorbent fibers, said upper layer and said lower layer being needle-bonded to one another.

2. The sole structure for a shoe or an inner sole according to claim 1, wherein said upper layer and said lower layer are needle-bonded so that a portion of said absorbent fibers of said lower layer extend as far as a center point of said upper layer.

3. The sole structure for a shoe or an inner sole according to claim 2, wherein said absorbent fibers of said lower layer extend to directly below a top surface of said upper layer.

4. The sole structure for a shoe or an inner sole according to claim 1, wherein said fleece is made from polyester.

5. The sole structure for a shoe or an inner sole according to claim 1, wherein said lower layer is a fleece.

6. The sole structure for a shoe or an inner sole according to claim 5, wherein said fleece of said lower layer is made from a viscose material.

7. The sole structure for a shoe or an inner sole according to claim 5, wherein said fleece of said lower layer is made from polyamide.

8. The sole structure for a shoe or an inner sole according to claim 5, wherein said fleece of said lower layer is made from cotton.

9. The sole structure for a shoe or an inner sole according to claim 1, wherein said upper layer has a mass per unit area of 300 to 400 $g/m^2$.

10. The sole structure for a shoe or an inner sole according to claim 1, wherein said lower layer has a mass per unit area of 300 to 400 $g/m^2$.

11. The sole structure for a shoe or an inner sole according to claim 1, wherein a portion of said lower layer is made of a formable material comprising fusible fibers.

12. The sole structure for a shoe or an inner sole according to claim 1, wherein a portion of said lower layer is made of electrically conductive fibers.

* * * * *